US007090240B2

(12) United States Patent
Papac

(10) Patent No.: US 7,090,240 B2
(45) Date of Patent: Aug. 15, 2006

(54) TILTABLE SEATING APPARATUS FOR WHEELCHAIR

(75) Inventor: James B. Papac, Peachtree City, GA (US)

(73) Assignee: Plainsense Wheelchairs, Inc., Peachtree City, GA (US)

( * ) Notice: Subject to any disclaimer, the term of this patent is extended or adjusted under 35 U.S.C. 154(b) by 0 days.

(21) Appl. No.: 10/695,208

(22) Filed: Oct. 28, 2003

(65) Prior Publication Data

US 2005/0040626 A1 Feb. 24, 2005

Related U.S. Application Data

(60) Provisional application No. 60/422,187, filed on Oct. 28, 2002, provisional application No. 60/442,233, filed on Jan. 22, 2003, provisional application No. 60/468,871, filed on May 8, 2003.

(51) Int. Cl.
*B25H 5/00* (2006.01)

(52) U.S. Cl. ..... 280/647; 280/250.1; 297/DIG. 4; 297/325; 297/261.3

(58) Field of Classification Search ..... 297/DIG. 4, 297/42, 44, 452.22, 452.23, 452.24, 452.21, 297/452.25, 452.26, 201, 440.14, 452.4; 280/250.1, 32.6, 32.5, 650
See application file for complete search history.

(56) References Cited

U.S. PATENT DOCUMENTS

| | | | | | |
|---|---|---|---|---|---|
| 3,198,576 | A | | 8/1965 | Rosmarin | 297/342 |
| 4,046,418 | A | * | 9/1977 | Smith et al. | 297/118 |
| 4,402,546 | A | * | 9/1983 | Johnson | 297/374 |
| 4,625,984 | A | * | 12/1986 | Kitrell | 280/250.1 |
| 4,753,482 | A | | 6/1988 | Warren | 297/458 |
| 4,790,599 | A | * | 12/1988 | Goldman | 297/327 |
| 4,957,302 | A | * | 9/1990 | Maxwell | 280/32.6 |
| 5,244,252 | A | * | 9/1993 | Serber | 297/216.19 |
| 5,261,725 | A | * | 11/1993 | Rudolph | 297/361.1 |
| 5,301,964 | A | | 4/1994 | Papac | 280/250.1 |
| 5,333,887 | A | | 8/1994 | Luther | 280/250.1 |
| 5,516,195 | A | * | 5/1996 | Canteleux | 297/284.1 |
| 5,622,406 | A | * | 4/1997 | Meschkat et al. | 297/318 |
| 5,636,424 | A | * | 6/1997 | Singer et al. | 29/407.01 |
| 5,884,928 | A | | 3/1999 | Papac | 280/250.1 |
| 5,967,609 | A | * | 10/1999 | Potter | 297/325 |
| 6,012,774 | A | * | 1/2000 | Potter | 297/325 |
| 6,106,065 | A | * | 8/2000 | Carroll | 297/330 |
| 6,129,415 | A | * | 10/2000 | Galloway | 297/68 |

(Continued)

OTHER PUBLICATIONS

Brochure, "Slam'r No Limit", No Limit Designs, inc., Fresno, CA (prior to May 8, 2003).

(Continued)

*Primary Examiner*—Christopher P. Ellis
*Assistant Examiner*—Kelly E. Campbell
(74) *Attorney, Agent, or Firm*—Baker Donelson et al.

(57) ABSTRACT

A tiltable seating frame (10) for selectively positioning seating in a wheelchair, in which a seat platform (12) has opposing sides (18) that each extend to an arcuate distal edge (20) and each side defines an arcuate slot (22) parallel to the distal edge. A base (14) has opposing sides (70) that receive pairs of front and rear rollers (72, 74) on which the distal edges (20) travel. Each side (70) also receives a guide roller (76) attached intermediate and vertically spaced relative to the front and rear rollers (72, 74). The guide rollers (76) extend through the respective arcuate slot (22) of the seat platform (12), to guide the movement of the seat platform (12) relative to the base (14).

19 Claims, 7 Drawing Sheets

U.S. PATENT DOCUMENTS 6,213,551 B1 * 4/2001 Desnoyers et al. ..... 297/270.4
6,244,662 B1 * 6/2001 Porcheron ..... 297/383
6,250,717 B1 * 6/2001 Porcheron ..... 297/411.3
6,322,145 B1 * 11/2001 Melgarejo et al. ..... 297/354.11
6,382,725 B1 * 5/2002 Carroll ..... 297/330
6,450,578 B1 * 9/2002 Taggett ..... 297/325
6,488,332 B1 * 12/2002 Markwald ..... 297/68
6,491,342 B1 * 12/2002 Smith ..... 297/68
6,641,214 B1 * 11/2003 Veneruso ..... 297/322
6,886,843 B1 5/2005 Papac ..... 280/250.1
7,007,965 B1 * 3/2006 Bernatsky et al. ..... 280/304.1

OTHER PUBLICATIONS

Brochure, "Spectrum Pediatric Wheelchair", Scott Designs, Simi Valley, CA (prior to May 8, 2003).
Brochure, "Spectrum Pediatric Wheelchair", Scott Designs, a division of Freedom Designs, Inc., Simi Valley, CA (prior to May 8, 2003).
Brochure, "Spectrum Pediatric Wheelchair", Scott Designs, Basic Package (prior to May 8, 2003).

* cited by examiner

TILTABLE SEATING APPARATUS FOR WHEELCHAIR

This application claims priority to provisional application Ser. No. 60/422,187, filed Oct. 28, 2002, incorporated herein by reference; to provisional application Ser. No. 60/442,233, filed Jan. 22, 2003, incorporated herein by reference; and to provisional application Ser. No. 60/468,871, filed May 8, 2003, incorporated herein by reference.

TECHNICAL FIELD

The present invention relates to wheelchairs. More particularly, the present invention relates to seating apparatus for wheelchairs that provide tilting of the seating in relation to the wheelchair while maintaining the center of gravity of the wheelchair and the positioning of the occupant relative to the seating.

BACKGROUND OF THE INVENTION

Wheelchairs and other mobility devices provide disabled persons with equipment to be mobile and to increase opportunities for these persons to participate more fully in daily activities. Typical wheelchairs provide a chassis with wheels and include a cushioned seat and back seating system. The wheelchairs may be powered or self-propelled by pushing on the wheels.

Persons requiring this equipment often are seated in wheelchairs for long periods of time. Extended seating in a single position however leads to muscle fatigue. To provide relief from seating pressures of the body on the seating cushions, the positioning of the individual in the seat is changed to provide pressure relief and reduce fatigue. A fatigued person in a wheelchair tends to slump. This leads to bad posture. Fatigue and bad posture can lead to physical problems such as poor blood circulation, skeletal difficulties, and pressure sores.

To address this problem, mobility devices were provided with seating systems that could be tilted or re-positioned relative to the mobility base in order to change the position of the body relative to the seat. This re-positioning changes the contact area of the body to the seating surface and tends to reduce the pressure problems and fatigue problems noted above.

Traditional wheelchairs with adjustable tilt of seating required a long wheel base. This is because the mobility devices had to accommodate a rear fulcrum against which the seat would rotate. The long wheel base prevents the chair from tipping. While such wheelchairs provide tilting of seating relative to the chair, there are drawbacks to the use. In particular, the chair tends to be significantly heavier than a wheelchair which does not have seating which is tiltable. The wheelchair is typically larger. This makes the wheelchair more difficult to transport. The longer wheel base increases the turning radius which complicates maneuvering the wheelchair inside buildings.

Accordingly, there is a need in the art for an improved seating system for wheelchairs providing tilting of the seating relative to the wheelchair while maintaining the center of gravity and positioning relative to the seating. It is to such that the present invention is directed.

BRIEF SUMMARY OF THE INVENITON

The present invention meets the needs in the industry by providing a tiltable seating frame for selectively positioning seating in a wheelchair, comprising a seat platform having opposing sides that each extends to an arcuate distal edge and each side defines an arucate slot parallel to the distal edge. A base having opposing sides connects to a chassis of a wheelchair. Opposing pairs of front and rear rollers attach in spaced-apart relation to the sides of the base, so that the front and rear rollers on each side receive the distal edge of the respective side of the seat platform. One of a pair of opposing guide rollers attaches intermediate and vertically spaced relative to the respective front and rear rollers. The guide rollers extend through the arcuate slot of the respective side. The seat platform moves to a selected angled position relative to the base guided by the guide rollers moving in the arcuate slots and the distal edges traveling on the front and rear rollers.

Features, objects, and advantages of the present invention will be apparent upon reading the following detailed description in conjunction with reference to the appended drawings.

DETAILED DESCRIPTION

Figure 1:
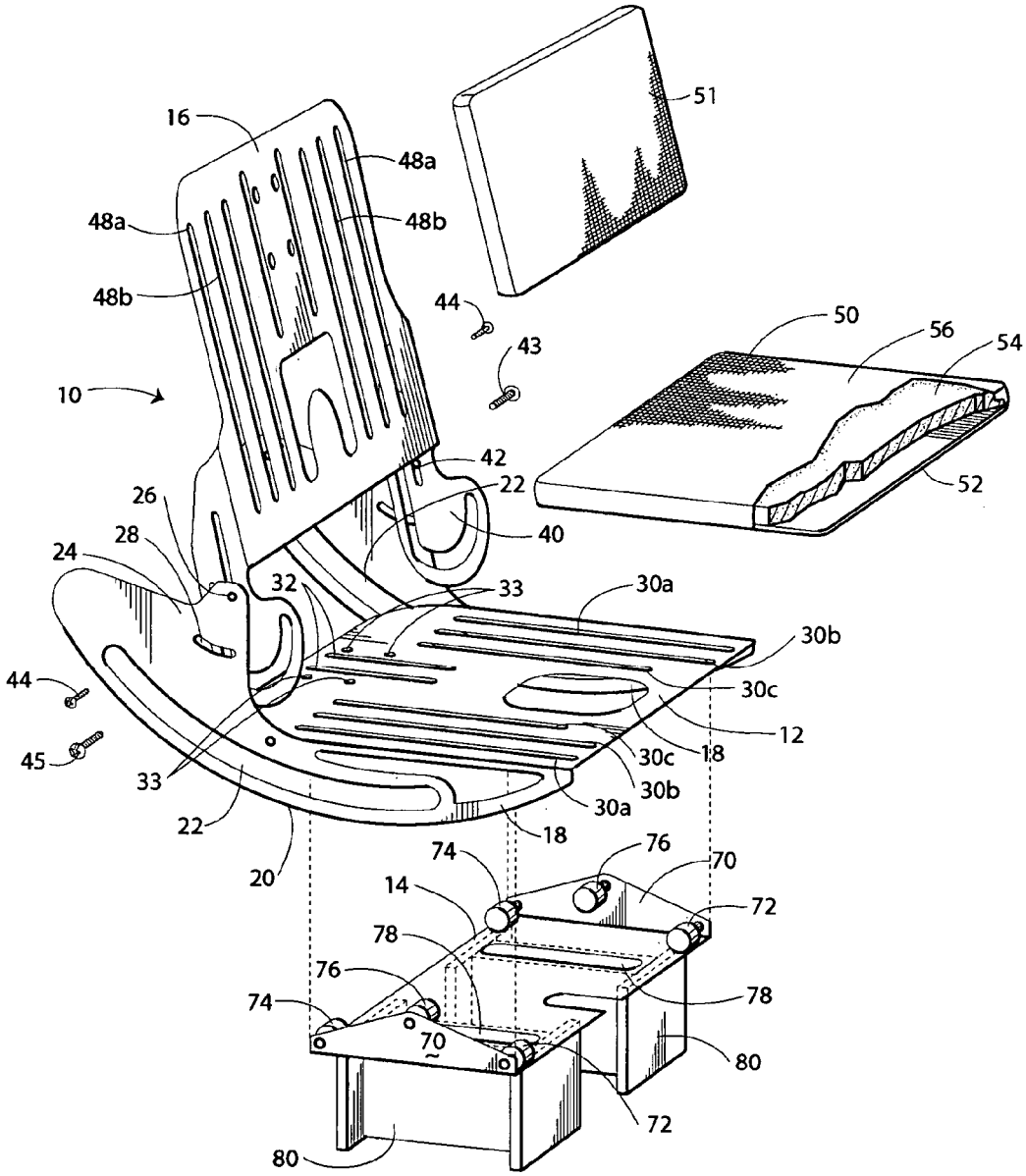
FIG. 1 illustrates in perspective exploded view a seating apparatus according to the present invention.

Referring now in more detail to the drawings, in which like numerals indicate like parts throughout the several views, FIG. 1 illustrates in perspective exploded view a seating apparatus 10 according to the present invention. The seating apparatus 10 includes a seat platform 12 connected to a base 14 and a back platform 16 pivotally connected to a rear portion of the seat platform. Opposing sides 18 extend from the seat platform 12. The opposing sides 18 each define an arcuate distal edge 20 and an arcuate slot 22. The arcuate slot 22 is spaced-apart and parallel to the distal edge 20. Opposing ears 24 project from a back portion of the seat platform 12. Each ear 24 defines a pivot opening 26 and a pivot slot 28. The pivot slot 28 is arcuate.

The seat platform 12 defines at least one pair of spaced-apart slots 30 that extend longitudinally from the back portion of the seat to a forward portion. The illustrated embodiment has three pairs of the slots 30*a*, 30*b*, and 30*c*. These slots provide for receiving fasteners to secure a seat cushion to the seat platform 12 and to secure lateral pads, supports, or arm rests. The seat platform 12 defines an additional pair of slots 32 disposed centrally and extending from the front portion to a central portion. The slots 32 terminate spaced from a central opening 34 defined in the bottom seat 12. Opposing pairs of openings 33 are defined spaced from the slots 32 in the back portion of the seat platform 12. The slots 32 and the openings 33 provide holes for receiving fasteners to secure accessory devices, such as pads having L-shaped positioning hardware, to the seat platform 12.

The back platform 16 pivotally connects to the seat platform 12. Pivot tabs 40 extend rearwardly on opposing sides of the back platform 16. The pivot tabs 40 each define spaced-apart openings 42, 43 that receive fasteners 44, 45 to connect the back platform 16 and the seat platform 12. The fastener 44 extends through the opening 42 and the aligned pivot opening 26 while the fastener 45 extends through the opening 43 and the aligned arcuate slot 28. The fasteners 44, 45 guide the pivoting of the back platform 16 relative to the seat platform 12. A lever-actuated cam-type locking nut can be used rather than a conventional nut on the fastener 44 to facilitate securing the back platform 16 in a selected angled position.

The back platform 16 also defines at least one pair of spaced-apart elongate slots 48*a*, 48*b* (four pairs of slots are illustrated.) The slots 48 receive fasteners for securing a cushioned pad to the back platform 16 as well as lateral positioning pads with L-shaped members.

FIG. 1 illustrates cushioned pads 50, 51 exploded from the seat platform 12 and the back platform 16. The cushioned pads 50, 51 each comprise a base 52, foam padding 54, and upholstery 56. The cushioned pads 50, 51 rigidly connect to the respective seat platform 12 and the back platform 16 with a plurality of threaded fasteners (not illustrated) that extend through the slots 30 in the seat platform 12 and the slots 48 in the back platform 16.

FIG. 1 illustrates the base 14 exploded away from the seat platform 12. The base 14 includes opposing sides 70. Each side 70 includes front and back rollers 72, 74 and a travel guide roller 76 mounted intermediate and vertically spaced from the front and back rollers. The rollers 72, 74, and 76 extend inwardly towards the opposing side 70. Each roller 72, 74, and 76 defines a central longitudinal bore which receives a threaded fastener to secure the roller to the seat platform and to be an axle about which the roller rotates. Each roller 72, 74, and 76 has a first diameter portion and a lateral second diameter portion. The rollers 72, 74, and 76 are T-shaped in profile. The rollers are machined from acetal or other material having a low friction characteristic. The front and back rollers 72, 74 receive the edge 20 of the sides 18 extending from the seat platform 12. The guide roller 76 extends through the pivot slot 28. The respective distal edge 20 of the sides 18 travel on the first diameter portion of the rollers 72, 74. The interior edges of the slot 22 travel on the first diameter portion of the roller 76. The second diameter portions of the rollers 72, 74, and 76 provide a lateral guide, to maintain the sides 18 tracking on the rollers 72, 74, and 76.

The base 14 further defines opposing openings 78 (in the illustrated embodiment the openings are elongate slots) which receive fasteners to connect seat columns 80 to the lower surface of the seat platform. My U.S. Pat. No. 5,884,928 describes seat columns and a frame column for detachably connecting seating apparatus to a chassis of a wheelchair. Other connecting members of types readily apparent to those of ordinary skill in the art can be used to connect the seat platform to wheelchair chassis.

Figure 2:
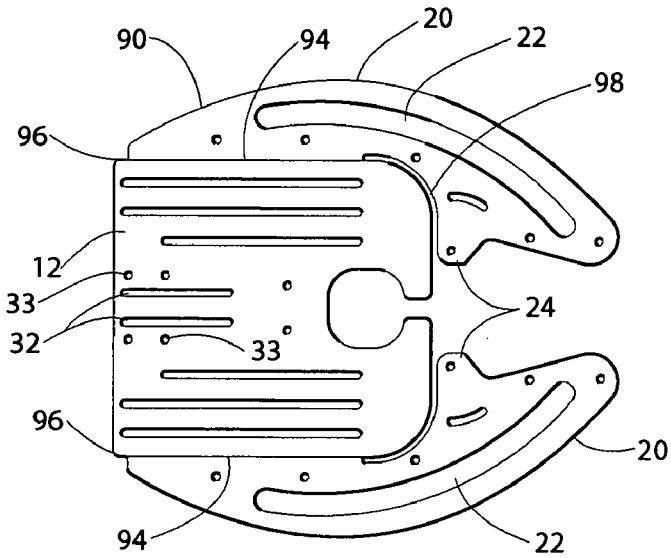
FIG. 2 illustrates a plan view of a sheet of material for forming the seat platform for the seating apparatus illustrated in FIG. 1.

FIG. 2 illustrates a plan view of a sheet 90 of foldable rigid material, such as a steel or aluminum plate for forming the seat platform 12 for the seating apparatus 10 illustrated in FIG. 1. The illustrated sheet 90 is symmetrical about a longitudinal axis 92. The sheet 90 folds along opposing side lines 94 extending between a front notch 96 and a back slot 98 to extend the sides substantially perpendicularly from the sheet. The slot 98 defines the ear 24.

Figure 3:
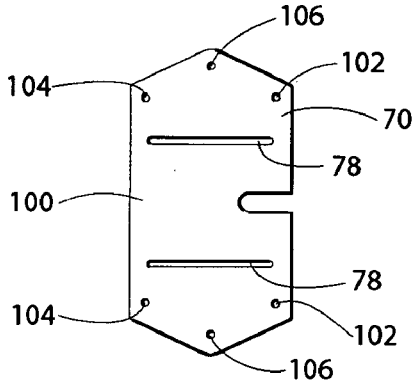
FIG. 3 illustrates a plan view of a sheet of material for forming the base for the seating apparatus illustrated in FIG. 1.

FIG. 3 illustrates a plan view of a sheet 100 of foldable rigid material for forming the base 14 for the seating apparatus 10 illustrated in FIG. 1. The opposing sides 70 extend vertically from the sheet 100 along fold lines. In an alternate embodiment, the opposing sides 70 are flat stock welded to opposing sides of a flat stock sheet. The base 14 is substantially U-shaped in front plan view. The sheet 100 defines openings 102, 104, and 106 for receiving the fasteners to connect the rollers 72, 74, and 76.

Figure 4:
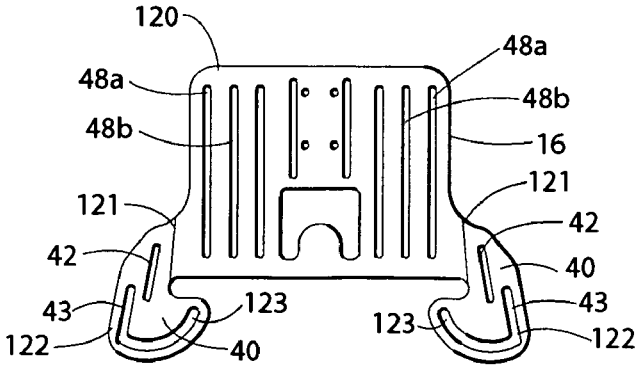
FIG. 4 illustrates a plan view of a sheet of material for forming the back platform for the seating apparatus illustrated in FIG. 1.

FIG. 4 illustrates a plan view of a sheet 120 of foldable rigid material for forming the back platform 16 for the seating apparatus 10 illustrated in FIG. 1. The opposing pivot tabs 40 fold on lines 121 to extend rearwardly from the sheet 120. In the illustrated embodiment, the opening 42 is an elongate slot while the opening 43 defines a slot spaced from the opening 42 and having an linear portion 122 and an arcuate portion 123.

When the back platform 16 is in use for seating, the fasteners 44, 45 extend through the openings 42, 43 at the vertically upper extents of the elongate slots. Fastener 44 tightened locks the back platform while the fastener 45 pins the back and seat platforms together. The back platform 16 however can be folded over substantially parallel to the seat platform 12. This is accomplished by loosening the fastener 44 and pulling upwardly on the back platform 16. When the bottom extents of the slots 42, 43, reach the fasteners 44, 45, the back platform 16 then pivots forwardly with the fastener 45 traveling in the arcuate portion 123 of the opening 43 and pivoting about the opening 42. The back platform 16 then may be secured in its forwardly folded position, such as with a strap (not illustrated). The seating assembly 10 with the seat columns 80 may then be detached from engagement with the wheelchair chassis for placing in a motor vehicle, in another device having a receiver for connecting with the seat columns 80 or in another mounting mechanism that connects to the seating platform 14.

Figure 5:
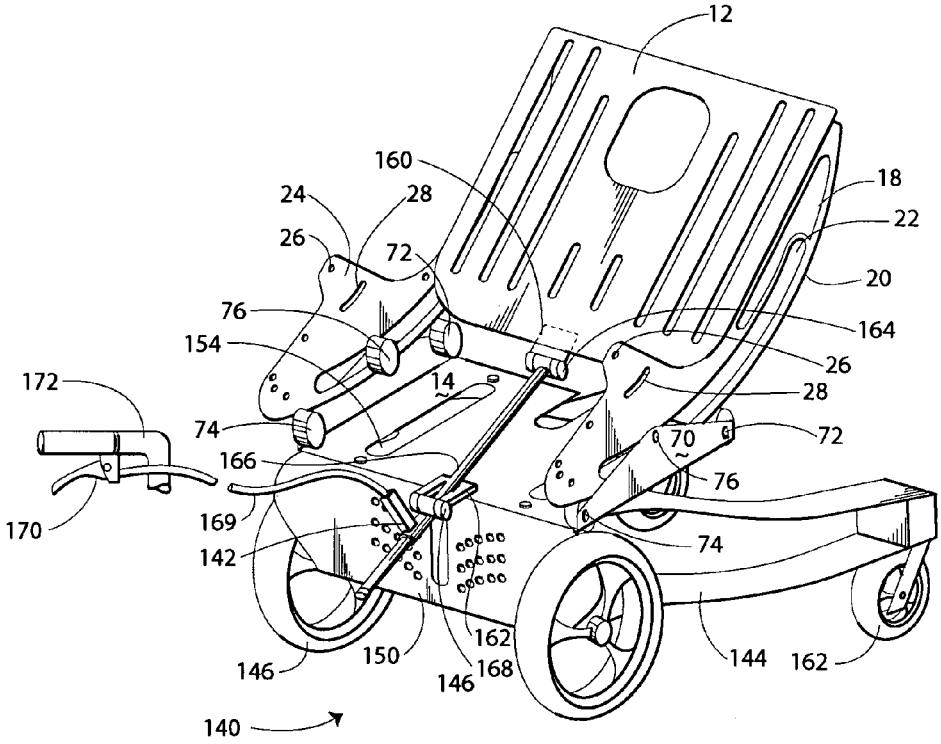
FIG. 5 illustrates a rear perspective view of wheelchair to show details of a position locking device used to selectively tilt the seating apparatus shown in FIG. 1 relative to the wheelchair chassis.

FIG. 5 illustrates a rear perspective view of wheelchair 140 to show details of a position locking device 142 used to hold the seating apparatus 10 in a selected tilted position relative to the wheelchair chassis 144. The wheelchair 140 is constructed according to the teachings of my U.S. Pat. No. 5,884,928, but the seating apparatus 10 of the present invention readily mounts to conventional tube-type wheelchairs with an adapter bracket. In the illustrated embodiment, the wheelchair 140 has stroller wheels 146 on opposing sides that connect with axles to axle mounts 148 attached with fasteners to a back portion 150 of the chassis 144. Castor wheels 152 connect to end portions of the forward extending arms of the chassis 144. Fasteners 154 connect the base 14 to the seat columns 80. The seat columns 80 are received in a tubular frame column 156 that connect between an upper portion and a lower portion of the chassis 144. The seat platform 12 and the base 14 connect together with the lower edges 20 of the sides 18 received on the rollers 72, 74. The rollers 76 insert through the respective slots 22 and fasten to the sides 70 of the seat platform.

A mount 160 connects with fasteners to a back portion of the seat platform 12 with fasteners passing through openings. A second mount 162 connects with fasteners to the back portion of the base 14. A pivotal connector 164 is held in the mount 160 and connects to a first end of a rod 166 extending from the position locking device 142. The rod 166 passes through a pivot axle 168 connected to the second mount 162. The position locking device 142 is a MECHLOK mechanical linear locking device available from P.L. Porter Controls of Woodland Hills, Calif. A cable 169 connects to the locking device 142 and connects at a distal end to a grip-lever 170 mounted to an upper end of a wheelchair push handle 172.

With reference to FIGS. 1 and 5, in the operation of the seating apparatus 10, the lever 170 is pulled to release the locking device 142 from engagement with the rod 166. The cable 169 actuates the locking device 142 to release the rod 166 from engagement. The seating assembly 10 then moves to a selected tilting relative to the wheelchair. This is accomplished by moving the seat platform 12 relative to the base 14. As the seat platform 12 moves, the arcuate edges 20 ride in the rollers 72, 74 and the rollers 76 move in the arcuate slots 22 to guide the movement to a selected angle tilt. The pivot connectors 164 and 168 rotate as the rod 166 moves longitudinally through the locking device 142 and thereby changes the angle of the rod 166 relative to the seat platform 12. Upon reaching a selected position for the seat platform 12 and the back platform 16, the locking lever 170 is released. The locking device 142 engages the rod 166 and holds the seating apparatus 10 in the selected tilted position.

With reference to FIG. 1, the back platform 16 is selectively positionable at an angle relative to the seat platform 12. This is accomplished by releasing the fasteners 44, 45 and pivoting the back platform 16. A bushing disposed between the ear 24 and the pivot tab 40 facilitates relative travel of the back platform 16 and the seat platform 12. The fastener 45 travels in the arcuate slot 28 about the pivot opening 26 secured by the fastener 44. The fasteners 44, 45 are tightened to secure the back platform 16 in the selected position. In an alternate embodiment, the fastener 44 is a pin that extends through the aligned openings 26 and 42. The fastener 45 is a cam-type locking lever.

Figure 6:
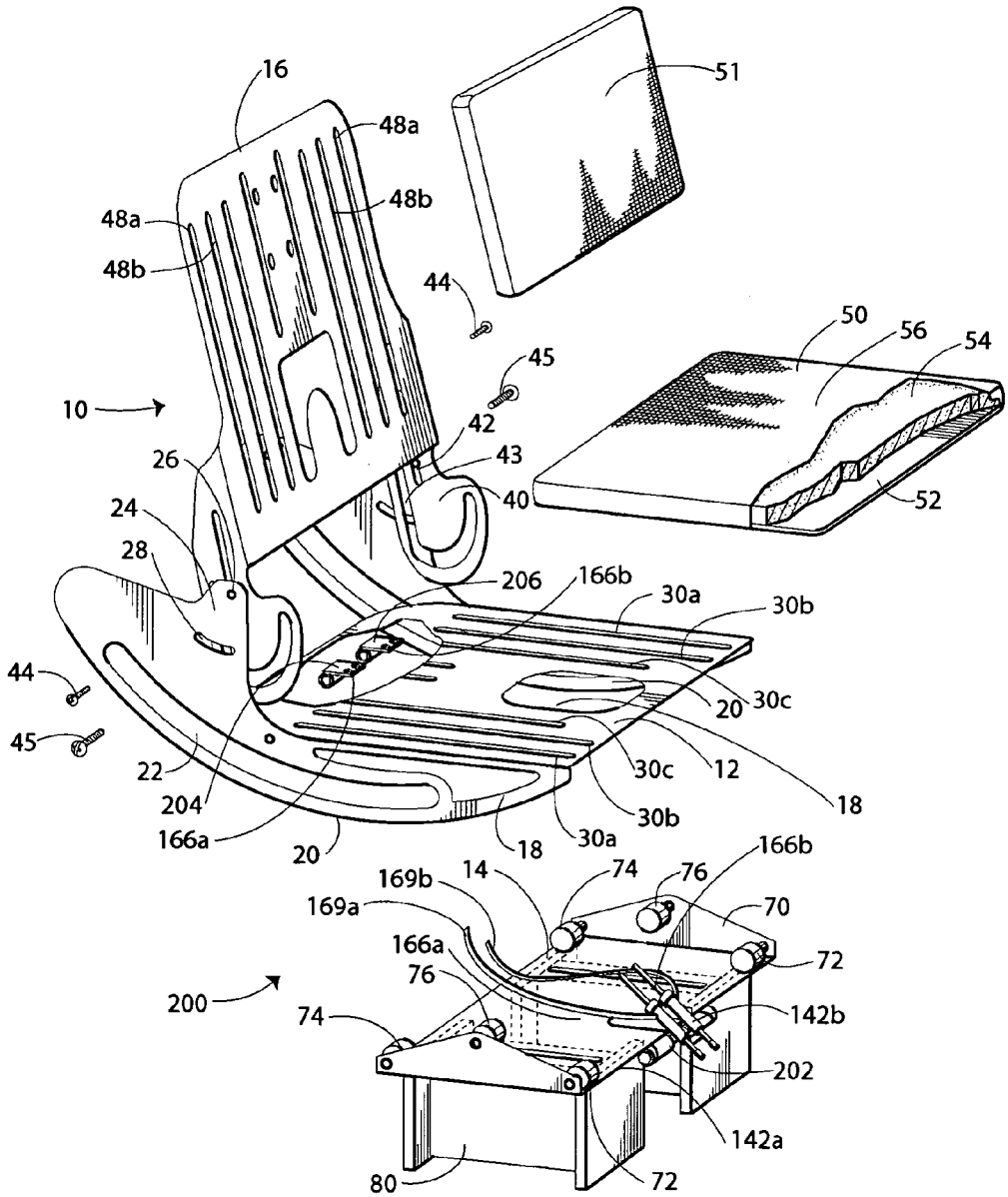
FIG. 6 illustrates a perspective exploded and partially cut-away view of a second embodiment of the seating apparatus according to the present invention.

FIG. 6 illustrates a second embodiment 200 of the seating apparatus 10 according to the present invention. The embodiment 200 uses two of the position locking devices 142 illustrated in FIG. 5. The position locking devices 142*a*, 142*b* mount in spaced-apart relation between the base 14 and the seat platform 12. The position locking devices 142*a*, 142*b* connect to a pivot support 202 at a forward edge of the base 14 and at respective pivot supports 204, 206 (illustrated in cut-away view) attached at rearward portions of the seat platform 12. The pivot support 204 attaches at a rearward edge of the seat platform 12, while the pivot support 206 mounts to a lateral portion of the seat platform 12 intermediate the rearward and forward edges of the seat platform. In this manner, the arms 166 of the respective position locking devices 142*a*, 142*b* are disposed at differing angles relative to the base 14. This provides a triangulation of the position locking devices relative to the seat platform 12 and the base 14 with the members 166*a*, 166*b* extending between spaced-apart pivot supports 202 and 204, 206. The pair of position locking devices 142*a*, 142*b* facilitate smoother movement of the seating assembly 10 relative to the base 14 upon release of the position locking devices using the grip levers 170. The cables 169*a*, 169*b* pass rearwardly in a gap between the base 14 and the seat platform 12 and extend upwardly on respective upright portions of the push handles 172 to grip-levers 170. The grip levers 170 mount to the upper ends of the push handles 172 as illustrated in FIG. 5.

Figure 7:
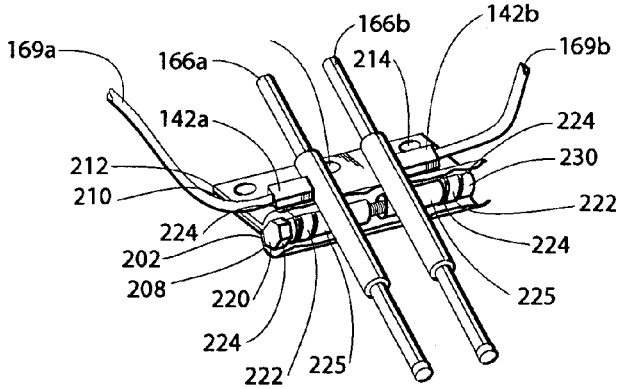
FIG. 7 illustrates a perspective partially cut away view of a pivot support for the position locking device used with the present invention.

FIG. 7 is a cut-away detailed illustration of the pivot support 202. The pivot support 202 comprises an extrusion that defines a substantially cylindrical portion 208 illustrated in cut-away view with a pair of spaced-apart flange members 210, 212 extending laterally. Aligned openings 214 in the flanges 210, 212 receive bolts (not illustrated). The bolts secure the pivot support 202 to the base 14. The bolts also function to tighten the flanges together and thereby reduce the diameter of the cylindrical portion 208 slightly for a purpose discussed below.

The cylindrical portion 208 receives a bolt 220 that extends longitudinally through the cylindrical portion. The bolt 220 receives a spacer 222 sandwiched between a pair of washers 224. A pivot member 225 of the position locking device 142*a* is received on the bolt 220. A second set of the spacer 222 sandwiched by the washers 224 is received on the bolt 220. The pivot member 225 of the second position locking device 142*b* is received on the bolt. A third set of the spacer 222 and washers 224 is received on the bolt 220. A nut 230 received on the bolt 220 secures the assembly.

The pivot support 202 mounts to the base 14 at a forward edge. The fasteners extend through the openings 214 and the base 14 and are secured with lock nuts. Securing the fasteners causes the substantially cylindrical portion 208 to close together, and the side walls thereof bear on the outer surface of the spacers 222. This secures the bolt 220 and the assembly within the pivot support 202. The pivot members 225 of the position locking devices 142*a*, 142*b* are independently pivotable on the bolt 220 as the seat assembly 10 moves relative to the base 14.

The pivot supports 204, 206 are similarly assembled and used, with a second pivot member of the position locking devices 142*a*, 142*b* received on the bolt in the respective pivot support 204, 206. The pivot supports 204, 206 each include a bolt and two sets of the spacer and washers sandwiching the respective second pivot member and secured with a nut. The pivot supports 204, 206 attach to the seat platform 12 in spaced-apart relation. This defines differing angles for the rods 166*a*, 166*b* of the position locking devices 142*a*, 142*b* extending between the pivot supports 204, 206 and the pivot support 202.

Figure 8:
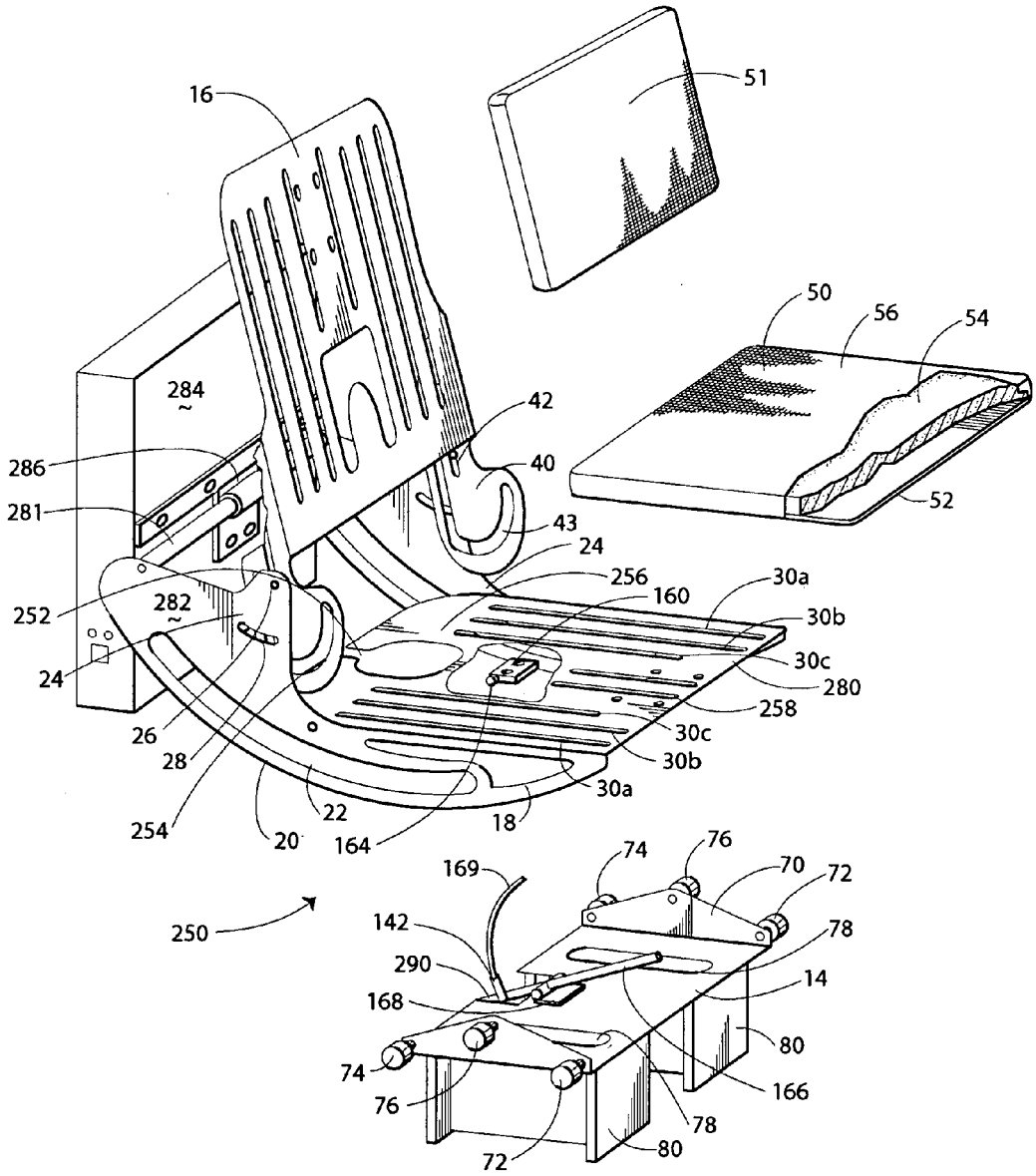
FIG. 8 illustrates in perspective exploded view a third embodiment of the seating apparatus according to the present invention.

FIG. 8 illustrates in perspective exploded view a third embodiment 250 of the seating apparatus according to the present invention. In this embodiment, the seat platform 12 defines a slot 252 extending from a rearward edge 254 inwardly to an opening 256. A pair of spaced-apart slots 258 extend longitudinally from a portion of the seat platform 12 near a forward edge of the opening 256 towards a front edge 260. Fasteners extend through the slots 258 and secure the mount 160 intermediate the opening 256 and the front edge 260.

A transverse mount bar 281 extends between rearward portions 282 of the opposing sides 18 rearwardly of the back platform 16. In the illustrated embodiment, a ventilator 284, such as a PULMONETIC LTV950 available from Pulmonetic Systems, Minneapolis, Minn., pivotally connects by a pivot member 286 to the transverse mount bar 281.

The seat base 14 defines a notch 290 in a rearward edge portion. The mount 162 connects with fasteners to a surface of the seat base 14 opposing the seat platform 12. The mount 162 is disposed rearwardly of the mount 160 on the seat platform 12. The position locking device 142 connects to the mount 162. The rod 166 connects at a distal free end to the mount 160 on the seating platform 12. A notch (not illustrated) may be required in the portion of the seat base 14 that defines the forward edge of the notch 290, for allowing passage of the rod 166. The connection of the rod 166 to the mounts 160 and 162 interlinks the seat platform 12 with the seat base 14. In addition, in this embodiment, the rollers 72, 74, and 76 are disposed extending laterally from the opposing sides 70 of the seat base 14. The distal edges 20 of the opposing sides 18 of the seat platform 14 ride on the rollers 72 and 74, while the roller 76 extends through the arcuate slot 22. In this embodiment, the seat base 14 is narrower than the seat platform 12, whereby the sides 18 are disposed outwardly of the sides 70 of the seat base 14.

Figure 9:
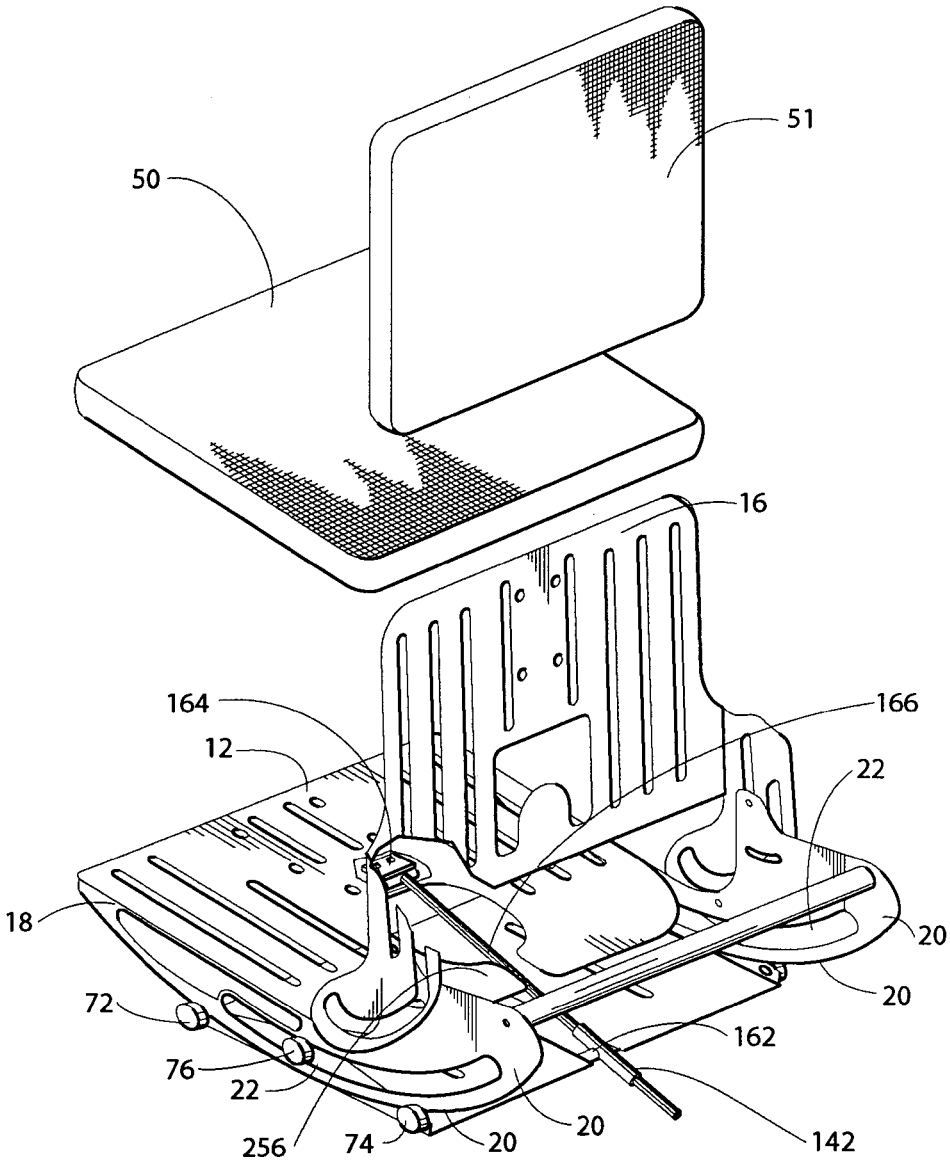
FIG. 9 illustrates a rear perspective view of the seating apparatus illustrated in FIG. 1 to show details of a position locking device that selectively tilts the seating apparatus relative to a wheelchair chassis.

FIG. 9 illustrates a rear perspective view of the third embodiment 250 of the seating apparatus to show features of seat platform 12 and the seat base 14 that allow the rod 166 of the position locking device 142 to pivot without obstruction by the seat platform and the back platform as the seating assembly tilts to a selected position with the guide edge 20 and edges of the slot 22 traveling on the rollers 72, 74, and 76. These features include the slot 252 and the opening 256 in the seating platform 12 and the notch 290 in the seat base 14. The seat platform 12 selectively tilts relative to the seat base 14 as the edge 20 and the edges in the slot 22 travel on the rollers and thus positions relative to a wheelchair chassis or other device to which the seat base 14 connects.

As the seat platform 12 moves relative to the seat base 14 or as the seat back 16 pivots relative to the seat platform 12, the ventilator 284 attached to the back platform 16 pivots relative to the transverse mount bar 281. The ventilator 284 is disposed conveniently relative to the seating for the user of the seating apparatus of the present invention.

Figure 10:
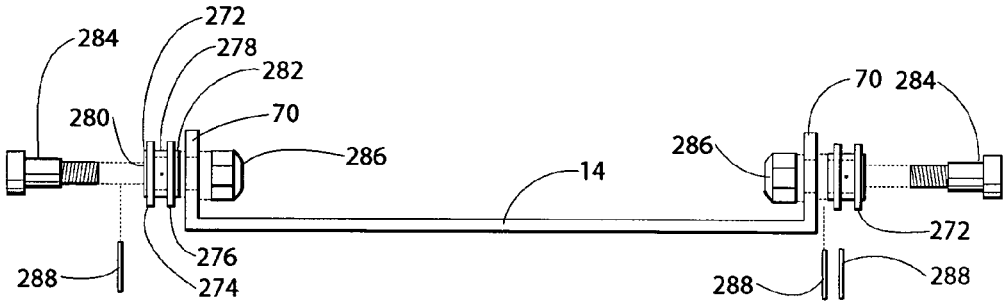
FIG. 10 is a front elevational view of the seat platform with an embodiment of the rollers exploded away.

FIG. 10 is a front elevational view of the seat base 14 with a travel guide roller 272 exploded from the sidewall 70 of the seat base 12. Such a guide roller 272 is used for the rollers 72 and 74. The roller 76 can be a cylindrical roller. The guide roller 272 includes two spaced-apart radially extending flanges 274, 276 which define a recessed gap 278. The flanges 274, 276 are offset relative to respective distal ends 280, 282 of the roller 272. The first end portion 280 extends from the flange 274 a first distance while the second end portion 282 extends from the flange 276 a second distance. The difference in the extended portion allows the roller 272 to be positioned in a first position relative to the side wall 70 or flipped over and oriented in a second position relative to the sidewall. This accommodates the fitting receiving of the arcuate edges 20 in the rollers during operation. (Variation occurs because the bending of the side 18 of the seat platform 12 is not perfectly normal.)

The roller 272 defines a bore through which a threaded fastener 284 extends. The threaded fastener 284 has a non-threaded portion on which the roller 272 rotates. A threaded end connects to a nut 286 to secure the threaded fastener 284 to the side 70. One or more washer shims 288 can be received on the fastener 284 to facilitate lateral positioning of the roller 272 in alignment with the arcuate edge 20 of the side 18. In addition, the roller 272 may be sized to leave a travel gap between the head of the fastener and the sidewall 70, to allow for lateral movement of the roller as the seat platform 12 moves relative to the seat base 14. The front rollers 72, 74 control twisting of the seat platform while roller 76 guides travel.

Figure 11:
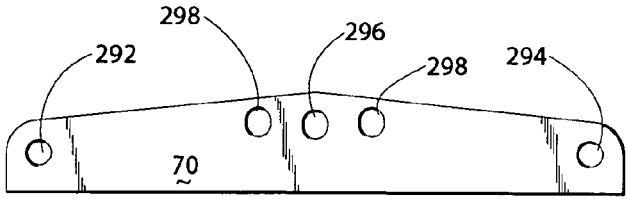
FIG. 11 is a side elevational view of the seat platform.

FIG. 11 is a side elevational view of the seat base 14. The side 70 defines openings 292, 294 through which the threaded fasteners for the front and rear rollers 72, 74 extend. The openings 292, 294 are round for receiving the threaded fastener. The side 70 defines an opening 296 for the roller 76. The opening 296 can be oblong or ovalish or somewhat eliptical, with a longer axis oriented vertically relative to a ground over which a wheelchair would pass. This is accomplished by milling a round opening slightly in the opposing vertical directions. The slightly extended opening 296 facilitates positioning of the guide roller 76 after seating the arcuate edge 20 on the front and rear rollers 72, 74. The opening 296 gives some flexibility in positioning the roller 76, so that the seat platform 12 travels smoothly relative to the base 14. This is accomplished by mounting the roller 76 to push downwardly on the lower edge of the slot 22 to keep the edge 20 engaged to the front and rear rollers 72, 74. Another embodiment (shown in FIG. 11) further includes two laterally spaced openings 298, similarly milled to be slightly elongated in a vertical direction. Additional rollers mount with fastening members to the openings 298. These rollers can be mounted to bear force upwardly on the upper edge of the slot 22, or downwardly, to facilitate smoother sliding contact of the lower edge 20 with the front and rear rollers 72, 74 as the seat platform 12 moves relative to the seat base 14.

The present invention accordingly provides seating apparatus for wheelchairs with selective tilting of the seat platform and the back platform in relation to the wheelchair while maintaining the center of gravity of the wheelchair and the positioning of the occupant relative to the seating. The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departure from the spirit of the invention as described by the following claims.

What is claimed is:

1. A tiltable seating frame for selective positioning of seating in a wheelchair, comprising:

a seat platform having opposing sides that each extends to an arcuate distal edge and each side defining an arcuate slot parallel to the distal edge;

opposing supports extending from a chassis of a wheelchair towards the seat platform;

opposing pairs of front and rear rollers attached in spaced-apart relation to the supports, the front and rear rollers on each support in contact with the distal edge of the respective side extending from the seat platform;

at least a pair of opposing guide rollers each attached to a respective one of the supports intermediate and spaced towards the seating platform relative to the respective front and rear rollers and extending through the arcuate slot of the respective side of the seat platform, the guide rollers each mounted on a respective shaft that extends through an elongate opening defined in each support intermediate the front and rear rollers for selective adjustable positioning of the guide rollers to accommodate smooth travel of the seat platform on the rollers; and fasteners received on the threaded end of the shaft to secure the shaft in a selected position, whereby the seat platform moves to a selected angled position relative to the chassis by the guide rollers moving in the arcuate slots and the distal edges traveling on the front and rear rollers.

2. The tiltable seating frame as recited in claim 1, wherein the seat platform defines at least two spaced-apart parallel slots extending between a rear portion and a forward portion thereof;

a cushioned pad received on the seat platform; and fasteners extending through the slots to secure the cushioned pad on the seat platform, the slots permitting the relative positioning of the cushioned pad relative to the forward portion.

3. The tiltable seating frame as recited in claim 2, further comprising a back platform pivotally connected to the seat platform and defining at least two spaced-apart parallel slots extending from a first portion of the back platform to a second portion thereof;

a cushioned pad received on the back platform; and fasteners extending through the slots of the back platform to secure the cushioned pad on the back platform, the slots permitting the relative positioning of the cushioned pad relative to the second portion.

4. The tiltable seating frame as recited in claim 1, further comprising an extendable rod pivotally connected at one end to the seat platform and pivotally supported by the chassis, for guiding the tilting position of the seating frame.

5. The tiltable seating frame as recited in claim 4, further comprising a releasable locking device that moves between an engaged position and a released position relative to the rod for holding the seating frame in a selected position when the locking device is in the engaged position and allowing the seating frame to tilt to a selected tilted position when the locking device is in the released position.

6. The tiltable seating frame as recited in claim 1, further comprising a releasable locking device that moves between an engaged position and a released position relative to the seating frame for holding the seating frame in a selected position when the locking device is in the engaged position and allowing the seating frame to move to a selected tilted position when the locking device is in the released position.

7. The tiltable seating frame as recited in claim 1, wherein the front and rear rollers and the guide rollers each have a lateral radially extending flange for a travel guide on a side of the respective roller.

8. The tiltable seating frame as recited in claim 1, further comprising:

a transverse bar extending between the opposing sides of the seat platform;

a ventilator device pivotally attached to the transverse bar.

9. The tiltable seating frame as recited in claim 1, wherein the front and rear rollers and the guide rollers extend outwardly in opposing directions from the supports.

10. The tiltable seating frame as recited in claim 1, wherein the front and rear rollers and the guide rollers extend inwardly from the supports towards the opposing support.

11. The tiltable seating frame as recited in claim 1, further comprising a back platform connected to the seating platform for pivotally movement to a selected angle relative to the seating platform.

12. The tiltable seating frame as recited in claim 1, wherein the front and rear rollers and the guide rollers each has a portion with a first diameter and a lateral portion with a second diameter greater than the first diameter, whereby the lateral portion guides the sides tracking on the roller.

13. The tiltable seating frame as recited in claim 1, wherein the front and rear rollers and the guide rollers each has a pair of lateral flanges extending radially to a first diameter and defining a bearing surface therebetween having a second diameter less than the first diameter, whereby an edge of the side travels on the bearing surface guided by the lateral flanges while tilting the seating frame to a selected position.

14. The tiltable seating frame as recited in claim 1, further comprising a pair of supplemental rollers mounted with the guide roller therebetween in openings that permit adjusting relative to the guide roller for applying bearing pressure against an edge of the side of the seat platform during tilting thereof.

15. A method for selective moving of a tiltable seating frame in a wheelchair, comprising the steps of:

(a) providing a seat platform with opposing sides that each extends to an arcuate distal edge and each side defining an arucate slot parallel to the distal edge and defining an elongated opening intermediate a leading and trailing end portion of the side;

(b) contacting the arucate distal edge of the seat platform on opposing pairs of front and rear rollers attached in spaced-apart relation to supports connected to a chassis of a wheelchair for travel relative thereto; and (c) guiding the travel of the seat platform with opposing guide rollers attached to the supports intermediate the respective front and rear rollers and extending through the arcuate slot of the respective side of the seat platform in contact with an edge thereof, the guide rollers each mounted on a respective shaft that extends through the elongate opening for selective adjustable positioning of the guide rollers to accommodate smooth travel of the seat platform on the rollers; and fasteners received on the shaft secure the shaft in a selected position, whereby the seat platform moves to a selected angled position relative to the chassis guided by the guide rollers moving in the arcuate slots and the distal edges traveling on the front and rear rollers.

16. The method for selective positioning as recited in claim 15, further comprising the step of releasably locking the seat platform in a selected arcuate position relative to the chassis.

17. A tiltable seating frame for selective positioning of seating in a wheelchair, comprising:

a seat platform having opposing sides that each extends in a first direction to an arcuate distal edge and defining an arcuate slot parallel to the arcuate distal edge;

a wheeled chassis having supports extending therefrom and defining a pair of first openings in opposing first and second end portions thereof and defining an elongated second opening intermediate the pair of first openings;

opposing pairs of front and rear rollers having shafts that extend through the respective first openings and sized for contacting reception on a side edge of the opening, the front and rear rollers in contact with the distal edge of the respective side extending from the seat platform for allowing the seat platform to move relative to the wheeled chassis; and a pair of guiders each extending through and contacting an edge of the arcuate slot of the respective side of the seat platform, and attached by a shaft extending through a respective one of the second openings, the shaft sized for selective positioning relative to a side edge of the second opening to accommodate smooth travel of the seat platform on the front and rear rollers;

whereby the seat platform guidingly moves to a selected angled position relative to the chassis.

18. The tiltable seating frame as recited in claim 17, further comprising a releasable locking device that moves between an engaged position and a released position relative to the seating frame for holding the seating frame in a selected position when the locking device is in the engaged position and allowing the seating frame to move to a selected tilted position when the locking device is in the released position.

19. The tiltable seating frame as recited in claim 17, wherein the guider comprises a roller.

* * * * *